US007644589B2

(12) United States Patent
Habatjou

(10) Patent No.: US 7,644,589 B2
(45) Date of Patent: Jan. 12, 2010

(54) COOLING DEVICE FOR A PRODUCT AND A PACKAGING AND DISPENSING ASSEMBLY FOR A CORRESPONDING PRODUCT

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 302 days.

(21) Appl. No.: 11/608,172

(22) Filed: Dec. 7, 2006

(65) Prior Publication Data

US 2007/0125097 A1 Jun. 7, 2007

Related U.S. Application Data

(60) Provisional application No. 60/751,970, filed on Dec. 21, 2005.

(30) Foreign Application Priority Data

Dec. 7, 2005 (FR) ..... 05 12431

(51) Int. Cl.
*B65B 63/08* (2006.01)
*B43M 11/02* (2006.01)

(52) U.S. Cl. ..... 62/60; 401/220

(58) Field of Classification Search ..... 62/60, 62/371; 30/41, 436; 239/102.2, 124; 604/289, 604/291; 128/57, 44, 51, 52, 65; 601/19; 401/208, 190, 197; 132/317
See application file for complete search history.

(56) References Cited

U.S. PATENT DOCUMENTS 2,892,202 A * 6/1959 Williams ..... 401/208
4,584,847 A 4/1986 Martello et al.
D300,958 S * 5/1989 Moore ..... D28/7
4,858,600 A * 8/1989 Gross et al. ..... 601/159
4,909,265 A * 3/1990 Goncalves ..... 132/317
5,189,890 A 3/1993 Kitayama
5,287,707 A 2/1994 Kitayama
2005/0005628 A1* 1/2005 Suh ..... 62/371
2005/0249541 A1* 11/2005 Habatjou ..... 401/220

FOREIGN PATENT DOCUMENTS

EP 0 459 508 12/1991
WO WO 2004/100704 11/2004
WO WO 2004100704 A1 * 11/2004

OTHER PUBLICATIONS

U.S. Appl. No. 11/514,173, filed Sep. 1, 2006, Habatjou.

* cited by examiner

*Primary Examiner*—Frantz F Jules
*Assistant Examiner*—Emmanuel Duke
(74) *Attorney, Agent, or Firm*—Oblon, Spivak, McClelland, Maier & Neustadt, L.L.P.

(57) ABSTRACT

A device is provided to cool and apply a product. The device includes a pressurized container configured to hold a liquefied refrigerant product. The pressurized container includes a longitudinal axis and is provided with a refrigerant product dispensing element with a product coating surface. The device also includes cooling means with at least one refrigerant product vaporization conduit connected in fluid communication with the refrigerant product dispensing element. The device further includes an applicator coating element disposed adjacent to the vaporization conduit so as to exchange heat with the vaporization conduit while the refrigerant product is dispensed from the dispensing element into the vaporization conduit. The applicator coating element typically includes a surface complimentary to an applicator so that the applicator may be coated with product.

28 Claims, 5 Drawing Sheets

COOLING DEVICE FOR A PRODUCT AND A PACKAGING AND DISPENSING ASSEMBLY FOR A CORRESPONDING PRODUCT

CROSS-REFERENCE TO RELATED APPLICATIONS

This document claims priority to French Application Number 05 12431, filed Dec. 7, 2005, and U.S. Provisional Application No. 60/751,970, filed Dec. 21, 2005, the entire content of which are hereby incorporated by reference.

FIELD OF THE INVENTION

The invention relates to a cooling device for a product. In one example, the device relates to a dispenser for a cosmetic product and also relates to a packaging and dispensing assembly for such a product imparting a refreshing effect upon application.

BACKGROUND OF THE INVENTION

Discussion of Background

It is desirable in certain cases to cool a cosmetic product for its application so as to enhance the effect thereof or to impart a sensation of freshness and comfort during application.

For this reason, when a user wishes to apply a pre-cooled cosmetic product onto his or her skin, the product is sometimes kept in a household refrigerator. When the product needs to be applied away from a household refrigerator, the pre-cooled product warms up rapidly, in particular when the ambient temperature is elevated, so that the product no longer imparts the refreshing effect sought.

Various types of packaging and dispensing assemblies exist that can be used to apply a cooled product. In this context, reference may be made to WO 2004/10 0704, which describes a cosmetic product dispenser used to apply a freshening product, and the dispenser is equipped with its own cooling device. The dispenser includes a first container holding the product to be applied and a second container holding a refrigerant gas. The product to be dispensed flows via a coiled tube to a dispensing aperture. The refrigerant gas flows through an annular conduit surrounding the product dispensing tube so as to cool the tube and the product contained therein while the product is being dispensed. The volume of product circulating in the tube is relatively large compared to the quantity of refrigerant gas, and it is typically necessary for the tube to be very long so that the gas has time to cool the product. The dispenser described in the aforementioned document is therefore relatively cumbersome and not ideal for a dispenser intended to be carried on the person.

Reference may also be made to document U.S. Pat. No. 4,584,847, which describes an assembly including a stick of lipstick and a device for cooling the stick. The stick is movably mounted relative to a holder so that it can be brought from a stowed position, in which the stick is disposed inside the holder, to a usage position in which the stick projects beyond the holder. The assembly includes a closure cap capable of being mounted on the holder when the stick is in the stowed position. This closure cap incorporates the cooling device.

The closure cap includes a base and a valved pressurized container holding a refrigerant gas. The pressurized container is mobile in the base so that actuation of the pressurized container valve is obtained by movement of the pressurized container relative to the base. The refrigerant gas is dispensed in doses in the direction of the lipstick. The majority of the refrigerant gas leaks through the gap left between the pressurized container and the base to allow the relative movement of the container with respect to the base. This assembly poses a problem in that the cooling effect cannot be obtained when the stick is in the usage position wherein it can be applied to a surface to be coated.

EP 0 459 508 describes a device in the form of a portable cooling kit for product doses supplied with the kit. However, the operation of such a kit involves numerous manual assembly steps for the user who wishes to make use thereof.

Reference may also be made to unpublished French Patent Application No. 0 552 654, which describes a cooling device for a product packaging device. The cooling device includes a pressurized container. The pressurized container holds a refrigerant product and a holder to receive the packaging device to be cooled. The holder is mounted on a valve with which the pressurized container is equipped so that the refrigerant product to be distributed is brought against an outer surface of the packaging device.

However, this cooling device is essentially applicable only for a product packaging device arranged in the form of a cup forming a reservoir filled with the product to be applied. It is in particular unsuitable for cooling a product intended to be applied by an applicator shaped as a ball or a rotating drum.

In light of the foregoing, one object of the invention is to overcome at least some of the aforementioned drawbacks associated with the use of conventional devices. Another object of the invention is to facilitate cooling of a product applied by a rotary type applicator in an arrangement of relatively small dimensions compatible with the manufacture of a product packaging and dispensing assembly that is of compact size and inexpensive to make.

SUMMARY OF THE INVENTION

One example of the invention includes a device to cool and apply a product. The device includes a pressurized container configured to hold a liquefied refrigerant product. The pressurized container includes a longitudinal axis and provided with a refrigerant product dispensing element. Also included are cooling means with at least one refrigerant product vaporization conduit connected in fluid communication with the refrigerant product dispensing element. The device further includes an applicator coating element with an applicator coating surface disposed adjacent to the vaporization conduit so as to exchange heat with the vaporization conduit while the refrigerant product is dispensed from the dispensing element into the vaporization conduit. The applicator coating element typically includes an applicator coating surface complimentary to an applicator so that the applicator may be coated with product. The applicator coating surface is itself intended and configured to be coated with product so as to coat the applicator.

Another example of the invention includes a packaging and dispensing assembly for a product including a product storage container equipped with an applicator and an applicator coating element with an applicator coating surface configured to coat the applicator with product fed from the product storage container. The assembly includes a product cooling device with a pressurized container holding a liquefied refrigerant product. The pressurized container includes a longitudinal axis and a refrigerant product dispensing element. The assembly further includes cooling means with at least one refrigerant product vaporization conduit connected in fluid communication to the refrigerant product dispensing element and disposed proximate to the applicator coating surface so as to exchange heat with the applicator coating surface.

According to one aspect of the invention, the assembly additionally includes a coating surface of a product applicator, and the vaporization conduit is disposed in relation to the coating surface in a manner so as to facilitate heat exchange therewith.

One example of the invention is particularly adapted to enable the application of a cooled product by means of an applicator including a rotating drum or ball type applicator in that, as the applicator rotates, the applicator can take up a cooled product from the applicator coating surface so that it can then be applied to the skin of a user.

According to one example of the invention, the vaporization conduit extends transversely, relative to the longitudinal axis of the container. The applicator coating surface can be generally concave in shape. The applicator coating element can be mounted transversely on the refrigerant product dispensing element.

For example, the coating element can be formed by the association of two plates, of which at least one is fashioned so as to form the vaporization conduit. The conduit can then be made by stamping or by machining one or both plates. In the present application, machining identifies processes of material removal via a rotating tool such as a vertical or horizontal end-mill. The vaporization conduit is typically disposed in relation to the applicator coating surface in a manner designed to facilitate heat exchange therewith. In one example, the applicator is a drum rotatably mounted relative to the applicator coating element, and the applicator coating element has a surface of a generally concave shape, which compliments the surface of the drum.

In one example, the drum is made of a deformable material and includes externally an arrangement of at least one boss. In this application, "deformable" means that the material can be significantly deformed by hand. For example, a deformable container would be capable of deformation in response to squeezing by hand so as to force the contents of the container out of the container. A deformable drum is deformable by the force exerted by hand when the drum is used to apply product so that the drum conforms to the shape of the surface to which it is applied. The boss can be formed on the external surface of the drum, or can be part of an internal structure which imparts a local deformation to the surface of the drum when the drum is pressed against a user's skin. The local deformation corresponds to the shape of an internal boss and functions to massage the user's skin.

In one example, the drum includes a rotary cylindrical support and a deformable application surface mounted around the rotary cylindrical support. In this case, the cylindrical support is provided with an arrangement of at least one boss configured to produce a localized deformation of the application surface during application of the product.

In addition, the application surface advantageously includes a median zone having a diameter greater than that of the cylindrical support such that when the cylindrical support rotates, the application surface is applied, on one side, against the support and, on the opposite side, is applied against the coating surface.

In one example, the drum is motorized. The assembly then includes a drive motor mechanically coupled to the drum. For example, the assembly can include a drum driving cylinder driven in rotation by the motor by means of a gear mechanism.

In one example, the driving cylinder is driven in rotation by the motor via a gear-motor system. In one example, the driving cylinder is driven in rotation by the motor via an overdrive system.

The packaging and dispensing assembly can include a switch that controls the operation of the motor. The switch can be designed to simultaneously control the operation of the refrigerant product dispensing element so as to cause the cooling device to be put into effect when the applicator rotates. In this manner, the applicator will rotate while refrigerant is dispensed from the refrigerant product dispensing element According to a further example of the invention, the storage container for the product to be dispensed is made of a manually deformable material. In this case, the assembly can be disposed in a casing provided with a manually deformable zone at least partially surrounding the first product storage container. The casing can additionally include a recess to receive power supply means for the assembly. One example of a power supply means would be a conventional nine-volt battery and associated connections to connect the battery.

As should be apparent, the invention can provide a number of advantageous features and benefits. It is to be understood that, in practicing the invention, an embodiment can be constructed to include one or more features or benefits of embodiments, disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
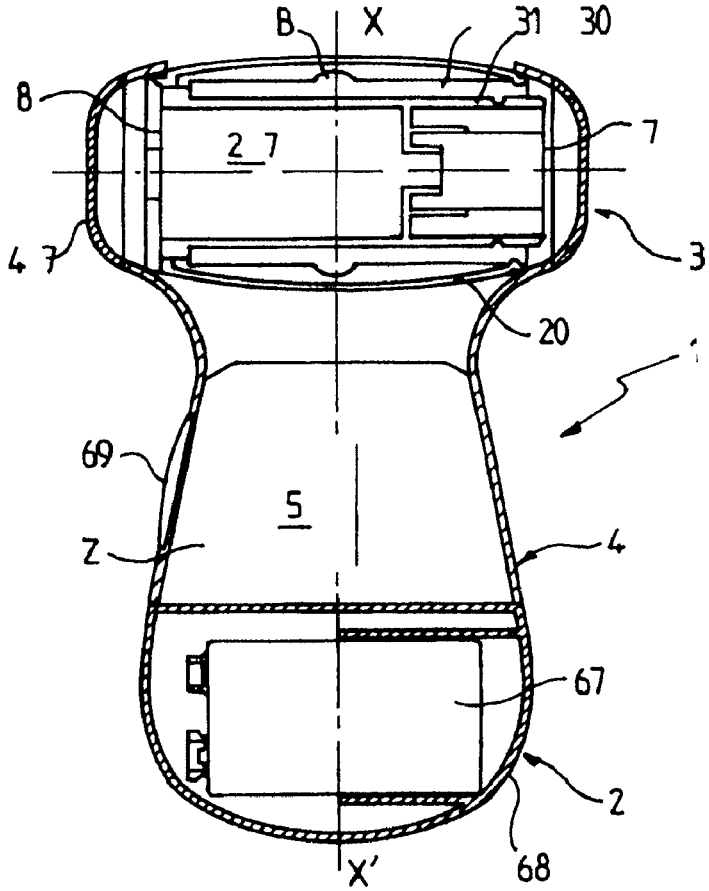
FIG. 1 is a sectional view of a packaging and dispensing assembly for a product according to one example of the invention.

Referring now to the drawings, wherein like reference numerals are used to designate identical or corresponding parts throughout the several views.

Figure 2:
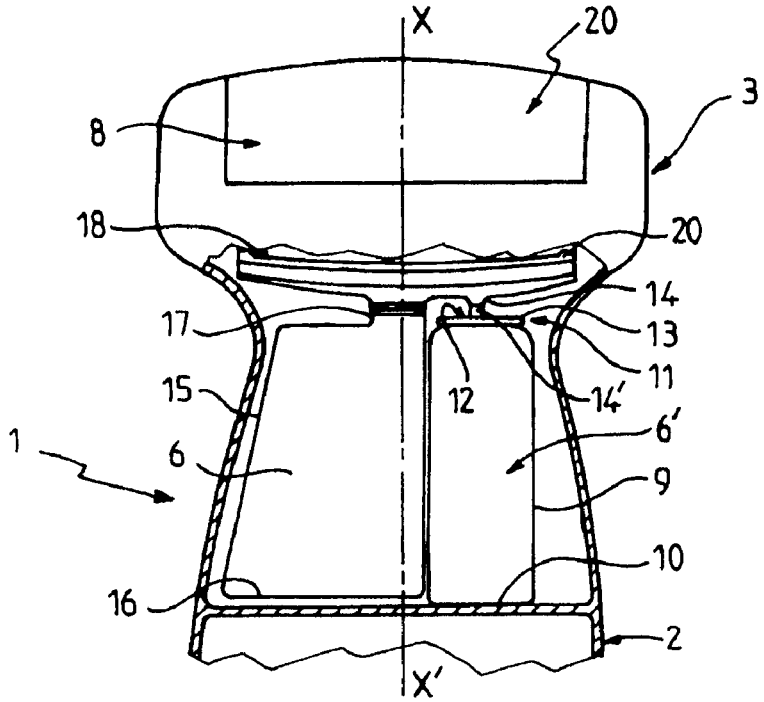
FIG. 2 is another lengthwise sectional view of the assembly in FIG. 1, showing the first and second storage containers, for the product to be applied and for the refrigerant product, respectively.

FIGS. 1 and 2 depict a first example of a product packaging and dispensing assembly according to the invention, denoted by the general numeric reference 1. The assembly 1 is configured to apply a cooled cosmetic product onto a user's skin so as to impart a freshening effect or to increase the effectiveness of the product applied by improving the penetration of the applied product into the skin.

For the purposes of the present description, the expression "cosmetic product" is understood to mean a product as defined in EC Council Directive 93/35/CEE dated 13 Jun. 1993. It will be noted, however, that the invention can also be used for packaging or dispensing any other type of product that one wishes to cool during application.

As shown in FIGS. 1 and 2, the assembly 1 has a longitudinal or lengthwise axis X-X'. It has a first proximal end 2 delineating a grasping zone for a user and an opposite distal end 3 serving, as will be described in detail below, to apply the cooled product.

The assembly 1 shown in FIGS. 1 and 2 typically includes a casing 4. The casing 4 is typically made of thermoplastic resin and internally delineates a first recess 5 configured to house a first container 6, which can hold the product to be dispensed, and a second container 6', which can hold a refrigerant product. The casing 4 typically includes a second recess 7, which can house a product applicator 8.

The refrigerant product stored in the second container 6' can produce a lowering of the temperature of the product supplied by the first container 6. It includes, for example, a fluid, which is in a liquefied state when under certain pressure and which drops in temperature when it expands to the gaseous state. It is, thus, typically stored under pressure in the second container 6'. Typical fluids can be a hydrocarbon, for example butane 3, 2, dimethylether, or a freon, for example HFC-134A. However, other fluids are possible.

The pressurized container 6' typically includes a cylindrical body 9 of which a first end 10 is closed and of which the opposite end 11 is provided with a cup 12 crimped onto a rolled rim 13 of the body 9. A dispensing valve 14 is typically retained by crimping in the cup 13. While the illustrated example depicts the body 9 of the pressurized container 6' as cylindrical, other shapes are possible.

The valve 14 is preferably a proportioning type valve so as to allow a measured quantity of refrigerant product to be dispensed when it is actuated and to avoid completely discharging the container during a single actuation.

As can be seen in FIG. 2, the valve 14 is typically provided with an actuating rod 14' of hollow shape. The dispensing of refrigerant product typically takes place when the actuating rod 14' is pressed downward. As a variant, it is also possible to use an actuating rod 14' that is actuated by tilting or an actuating rod activated by a downward and tilting movement.

The first product storage container 6, which is used for packaging of the product to be applied, includes a bottle or a pocket 15 with deformable wall. It can be made from a suitable thermoplastic resin or from a welded single-layer or multi-layer film, for example. It also typically includes a closed first end 16 and an open opposite end 17 forming a neck.

In the example shown in FIG. 2, the valve 14 of the pressurized container and the neck 17 of the first container are connected to a product diffuser 18 mounted transversely relative to the axis X-X' of the casing 4. The product diffuser serves at least two roles. In the first role, the product diffuser 18 distributes the product along the applicator 8 to coat the applicator. In the second role, the product diffuser functions to cool the product 18 as a result of the expansion of the refrigerant gas.

Figure 3:
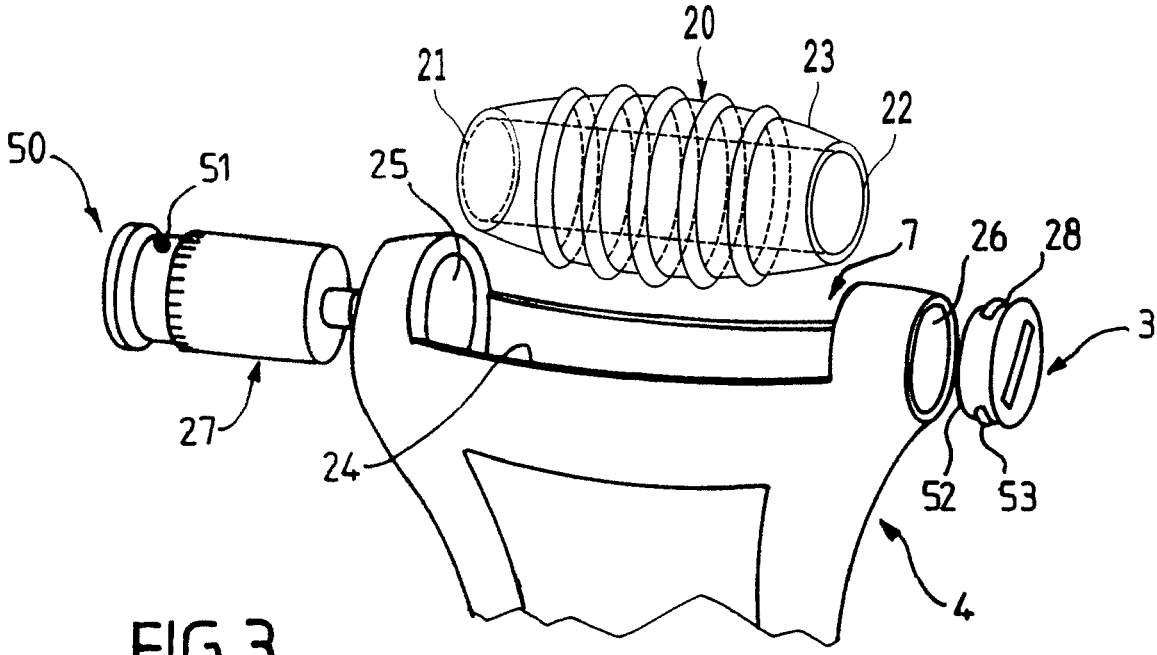
FIG. 3 is an exploded perspective view of an end portion of an assembly according to one example of the invention.

In the example illustrated in FIG. 3, the applicator 8 includes an applicator drum 20. In this example, the assembly includes a "roll-on" type dispenser. It will be noted, however, that the scope of the invention is not exceeded when the dispenser includes a "ball" applicator to form a "stick" type dispenser. In one example of the invention, the drum is motorized. In another example of the invention, the drum is not motorized.

In the example illustrated in FIG. 3, the applicator 20 is generally elliptical in shape and truncated at its two mutually opposite end portions 21 and 22. It thus provides a generally convex external application surface 23.

The drum 20 is typically mounted transversely in the recess 7 of the casing 4 in relation to the lengthwise axis X-X' of the assembly 1.

To this end, the distal end 3 of the casing 4 can be provided with a perforated cradle 24 (i.e., an applicator coating element with an applicator coating surface), which receives the drum 20. The cradle 24 is typically in fluid communication with the diffuser 18 or is formed by the diffuser 18 itself. The cradle 24 is intended and configured to be coated with product so as to impart the product to another surface. In the illustrated example, the cradle 24 extends transversely over a major portion of the distal end 3 of the casing 4. In the example shown in FIG. 3, the casing 4 includes two passages 25 and 26. The passage 25 is configured to receive a drive motor 27 that drives the drum 20, and the passage 26 is configured to receive an endshield 28 designed to lock the drum 20 in the cradle 24. The cradle 24 generally has a length corresponding to that of the drum 20. It has a shape complimentary to that of the drum 20. For example, when the drum 20 is a convex roller as shown in FIG. 3, the cradle 24 will generally have a truncated semi-ellipsoid shape and thus, the curvature of the drum 20 and the cradle 24 will be such that the distance between the drum 20 and the cradle 24 will be constant over at least a portion of their geometry.

When the drum 20 is inserted into the casing 4, it closes off the majority of the opening formed by the recess 7.

As will be further described in detail, the drum 20 is typically made of a resiliently deformable material, for example an elastomer. At rest, the outer surface of the drum 20 is flush with the distal end of the casing 4. However, in the example depicted in FIG. 3, the drum 20 also projects slightly beyond this end by its domed median portion. The surface of the drum 20 facing the cradle 24 is typically in contact with the bottom of the cradle 24.

Figure 4:
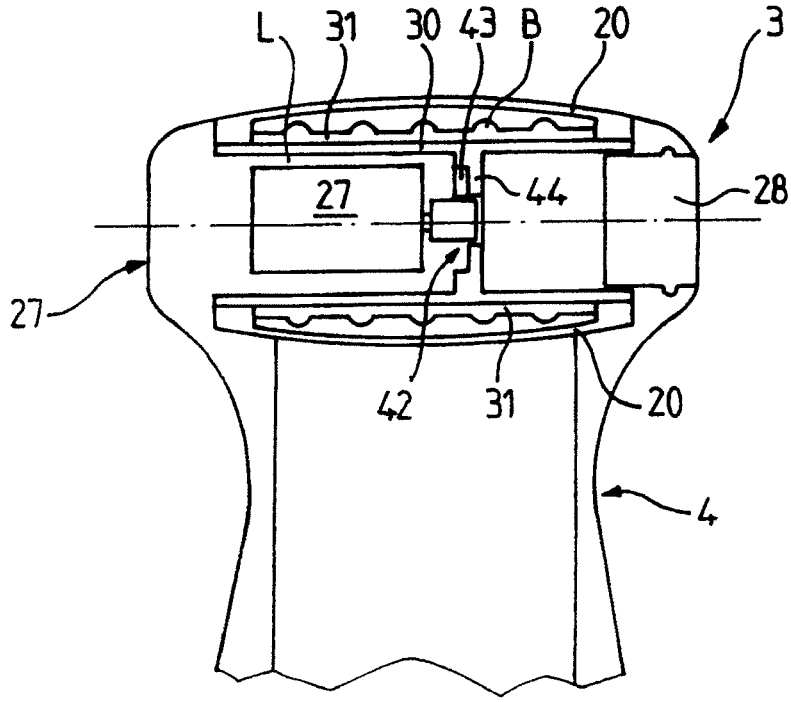
FIG. 4 is a lengthwise sectional view of a second example of the invention.
Figure 5:
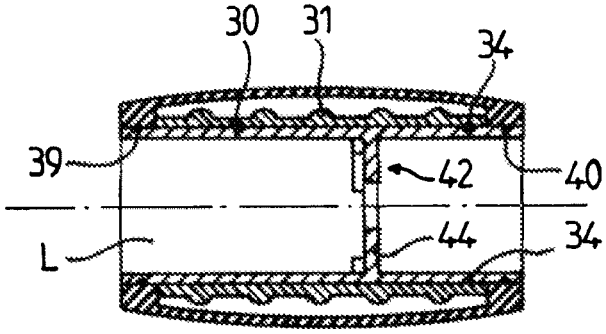
FIG. 5 is a sectional axial view of an applicator of the assembly in FIG. 4.

In use, that is to say when the drum is applied against the skin of a user, the outer surface of the drum can be applied against a boss B as shown in FIG. 4. When this occurs, the application surface 23 is radially deformed so that the application surface 23 of the applicator 8 assumes a bossed configuration, which has the effect of producing a massaging action during application. On the other hand, at its internal surface, facing towards the cradle 24, the drum 20 reverts to its initial domed configuration and comes into contact with the cradle 24.

It is also possible to provide the applicator 8 with a drum 20 including an outer surface in which the bosses are directly fashioned. However, the arrangement in which a drum 20 is used having a deformable outer surface 23 designed to momentarily assume a bossed configuration at the time of application is advantageous in that it improves the coating of the applicator by the cradle 24.

In the embodiment illustrated in FIG. 1, the drum rests on a single annular bead B. However, as can be seen in FIG. 4, it is also possible to provide a plurality of such annular beads B evenly spaced along the internal surface of the drum 20 so as to increase the massaging effect.

A detailed structure of the applicator of the assembly 1 will now be described with reference to FIGS. 5 to 11. The drum 20 and the application surface 23 forming the outer peripheral surface of the drum 20 can be seen in FIGS. 7 and 8.

In addition to the drum 20, the applicator is provided with a driving cylinder 30 which is adapted to cooperate with the motor 27 and a cylindrical support 31 mounted around the driving cylinder. The drum 20 is typically disposed around the cylindrical support and the driving cylinder.

Figure 6:
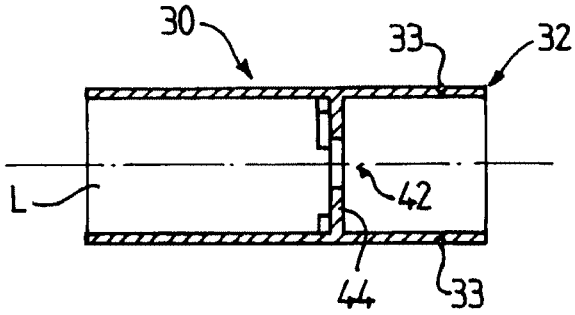
FIG. 6 shows a driving cylinder of the applicator in FIG. 5.
Figure 7:
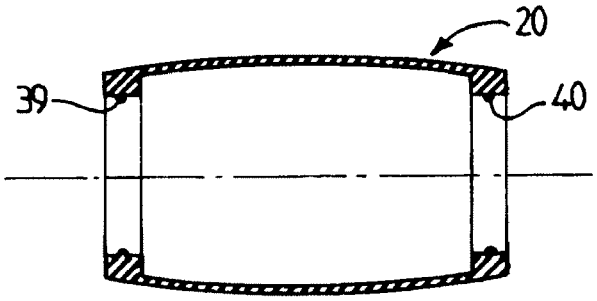
FIGS. 7 and 8 show an application surface of the applicator in FIG. 5.
Figure 8:
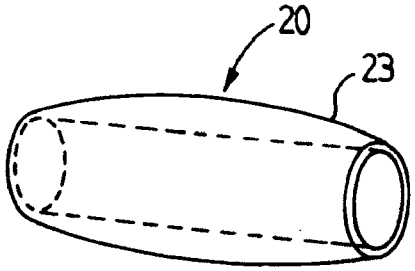
Figure 9:
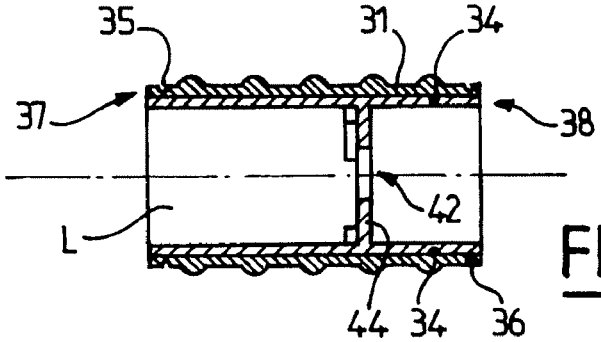
FIG. 9 shows a cylindrical support of the applicator in FIG. 5.

In the example shown in FIG. 6, the driving cylinder 30 has a cylindrical peripheral surface with a circular base. In proximity to one of its ends 32, it is provided with an annular groove 33 which engages with a counterpart bead 34 formed in the inner surface of the cylindrical support 31 (see FIG. 9) to mount the support 31 on the driving cylinder 30. The cylindrical support 31 is also provided with a pair of annular grooves 35 and 36 formed in proximity to its two end zones 37 and 38 to receive counterpart annular beads 39 and 40 provided internally at the two ends of the drum 20.

Assembly is typically carried out by mounting the support 31 around the driving cylinder 30 and inserting the inner bead 34 of the support into the peripheral groove 33 of the cylinder 30, then mounting the drum 20 around the support 31 and inserting the inner beads 39 and 40 into the corresponding grooves 35 and 36 of the support 31.

Figure 10:
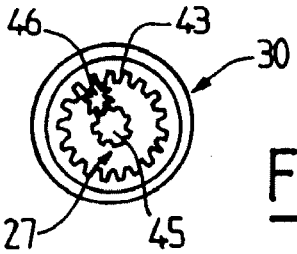
FIG. 10 shows a gear mechanism serving to drive the driving cylinder.
Figure 11:
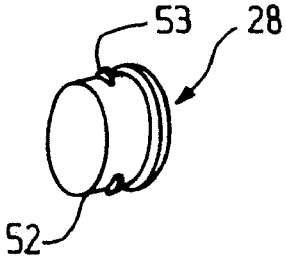
FIG. 11 is a diagrammatic perspective view of a locking plug serving to hold the applicator of FIG. 5.

In the example illustrated in FIGS. 6 and 10, the driving cylinder 30 is provided, internally, with a gear mechanism 42. It can thus be seen in these figures that the driving cylinder 30 can be provided internally, in a substantially median portion, with an inner toothed ring 43 which engages with a solar pinion 45 carried by the drive shaft of the motor 27 via a planetary wheel 46. The gear mechanism 42 forms a gear-motor. It is possible to interpose an overdrive system between the motor and the applicator, depending on the type of motor used.

The toothed ring 43 is carried by a shoulder 44 which delineates, with the inner surface of cylinder 30, a recess L adapted to accommodate the motor 27.

In effect, as shown in FIGS. 1 and 4 which correspond to two examples of an assembly according to the invention, during assembly, after mounting the drum 20 in the cradle 24, the motor 27 is inserted through the opening 25 in the distal end of the casing 4 then into the driving cylinder 30 until its solar pinion 45 meshes with the planetary wheel 46.

As shown in FIG. 3, the motor 27 is carried by an endshield 50. This endshield 50 can be locked onto the casing 4 with a quarter-turn locking system. Provision can be made on the motor 27 for a stud 51 or a screw thread designed to engage with a counterpart groove formed locally in the opening 25 of the casing.

On the opposite side of the casing 4, i.e., on the side of the opening referenced 26, the endshield 28 is configured to retain the drum 20 in the cradle 24. The endshield 28 is provided with a cylindrical extension 52 which, upon assembly, is inserted into the driving cylinder to ensure the alignment thereof.

This endshield 28 can also be provided with a quarter-turn locking mechanism. It is possible to have other types of locking mechanisms. The extension 52 will typically be provided with a screw thread or a stud 53, which engages in a counterpart groove formed in the casing 4 on the outer surface of the opening 26.

Figure 12:
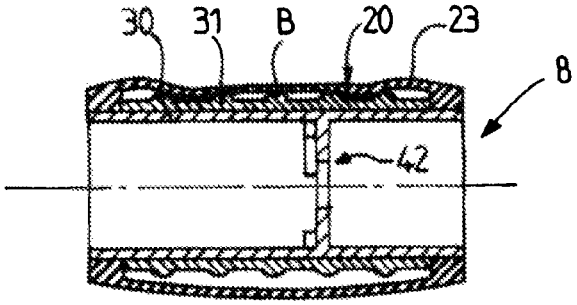
FIG. 12 is a sectional axial view of an applicator during operation.

As indicated previously, and as shown in FIG. 12, the drum 20 is made of a deformable material, for example an elastomer. At rest, the drum 20 extends substantially flush with the surface of the distal end of the casing 4. However, in the vicinity of its domed median zone, the drum 20 extends substantially outward beyond this end surface. The inner surface of the drum 20, that is to say facing towards the cradle 24, is domed and rests against the cradle 24.

As shown in FIG. 12, when in use, i.e., when the drum 20 is applied against the skin of a user, it deforms so that it is forced against the domed support. The drum 20 then assumes a bossed shape which imparts a massaging effect on application. However, it reverts to its initial domed shape facing towards the cradle 24. As indicated previously, the cradle is perforated and compliments a coating surface of the application surface 23 of the drum 20. For this purpose, it communicates with the diffuser or is integral therewith in forming the upper surface of the diffuser.

The general structure of the diffuser 18 will now be described in reference to FIGS. 13 to 23. The product diffuser 18 communicates with the first container 6 filled with product to be dispensed and with the second container 6' filled with refrigerant product. For this purpose, as shown in FIG. 13, the diffuser 18 is typically provided with a connector 56 for connection of the first container 6 and which is designed to be mounted in the neck 17, and a fitting 57 for a hose mounted on the actuating rod 14' of the valve 13 of the second container 6'.

Figure 14:
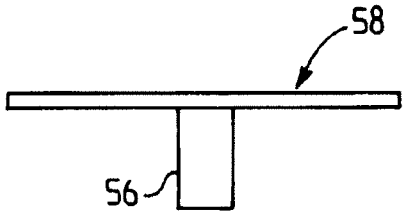
FIGS. 14, 15, 16, 17, 18 and 19 illustrate the make-up of the component in FIG. 13.
Figure 15:
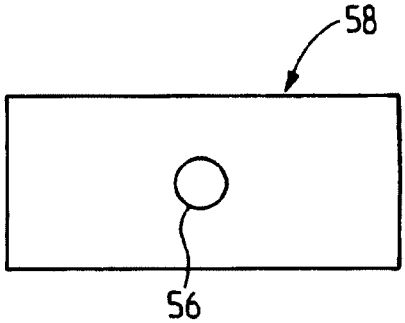
Figure 16:
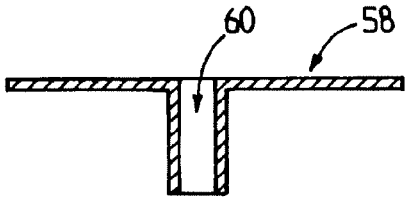

The diffuser 18 generally includes a first part 58 for admission of the product to be dispensed into the diffuser, visible in FIGS. 14, 15 and 16, which illustrate respectively a side view, a top view and a median sectional view of this first part 58, and a second part 59 serving to cool the product admitted into the diffuser by the first part 58.

Figure 13:
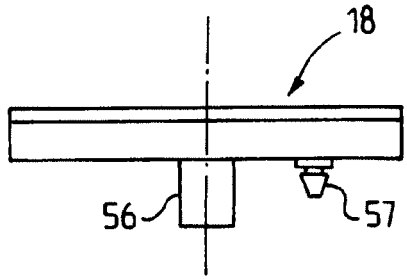
FIG. 13 is a profile view of a component part of a product packaging and dispensing assembly according to one example of the invention, illustrating the coating surface of the applicator.

The first part 58 is generally T-shaped (as shown in FIG. 13) and has a distal face forming a plate. It is typically made in one piece, for example of a thermoplastic material or of a metallic material. It is fitted with the connector 56 and is provided with an axial passage 60 to convey the product to be dispensed to the diffuser 18.

Figure 17:
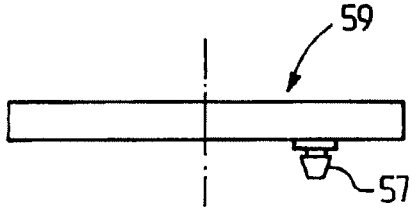
Figure 18:
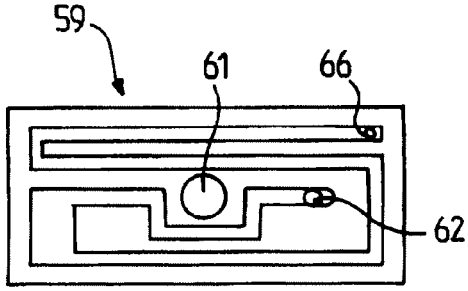
Figure 19:
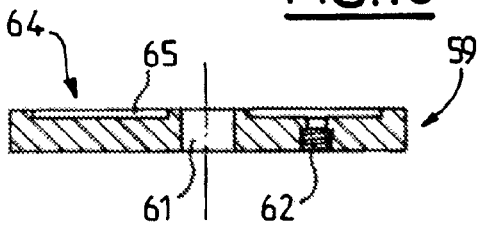

The second part 59 is generally in the shape of a plate as shown in FIG. 18, however, other shapes are possible. As depicted in FIGS. 17, 18 and 19, which show a side view, a top view and a median sectional view, respectively, the second part 59 is provided with an axial passage 61 shaped to receive the connector 56 of the first part 58. It also includes a threaded opening 62 into which is screwed the connection fitting 57 for the hose delivering cooling product to the diffuser 18.

The first part 58 is configured to be fitted on one of the principal faces 64 of the second cooling component 59 by inserting the connector 56 into the opening 61. As shown in FIGS. 18 and 19, the principal face 64 of the cooling part 59, which is intended to receive the first part 58, is provided with a groove 65 which follows a winding path from the inlet opening 62 to an outlet opening 66. The groove 65 typically has a rounded profile or a square profile, for example. When the first part 58 is mounted on the second part 59, the groove 65 forms a cooling conduit wherein the refrigerant product can circulate in the liquid state, after it has exited the second container 6', such that the cooling conduit cools the coating surface. More particularly, the cooling conduit extends transversely relative to the axis X-X' on the path of the product to be applied between the first container and the cradle.

The diffuser 18 can be mounted under the cradle 24. In one variation, the diffuser 18 can be shaped so as to form the cradle 24. In this case, the parts 58 and 59 assume a concave configuration to compliment that of the recess 7.

The cradle 24 is in any case provided with a plurality of apertures designed to allow the product to emerge therefrom. During use, the product from the first container 6 is flowed through the first part 58, is distributed over the entire surface of the cradle 24. Furthermore, the diffuser 18 is cooled by expansion of the refrigerant product in the groove 65. Consequential cooling of the product circulating through the cradle 24 can be performed before the product is taken up by the drum 20.

Figure 20:
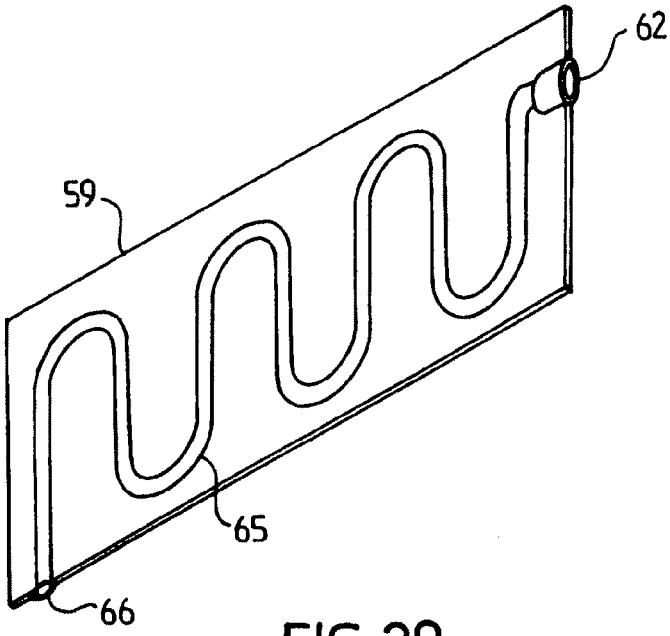
FIGS. 20 and 21 are perspective and profile views respectively of a first embodiment of a coating surface according to one example of the invention.
Figure 21:
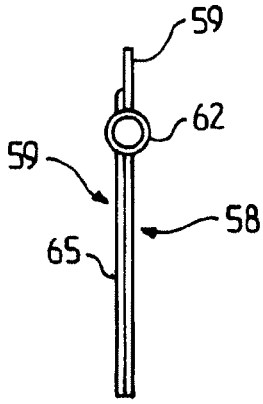

Referring now to FIGS. 20 and 21, it is apparent that the conduit 65 winding through the diffuser 18 between the inlet opening 62 and the outlet opening 66 can be made by shaping the face 64 on which the first part 58 rests. This shaping can be done by machining or by stamping, for example. It will be noted that stamping is particularly advantageous in that it enables channels, wherein the liquid will expand, to be formed simultaneously with the cutting of a metal plate.

Figure 22:
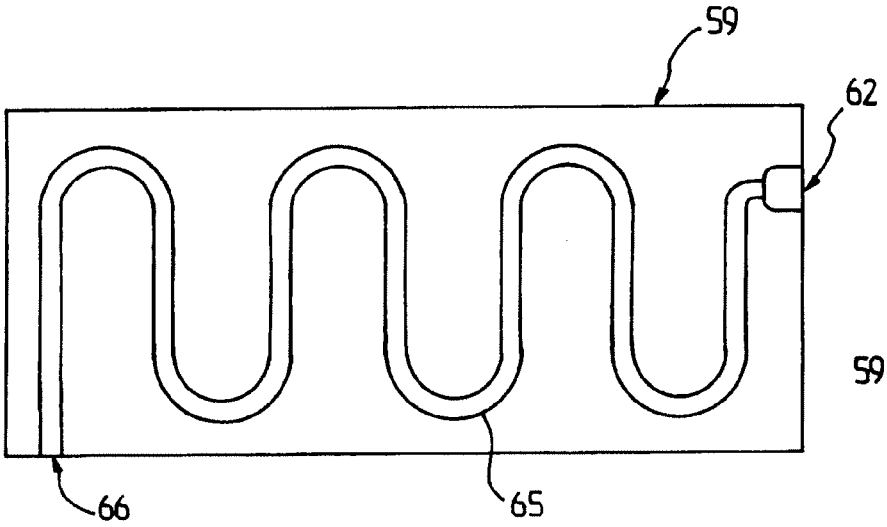
FIGS. 22 and 23 are front and profile views respectively of another example of a coating surface according to the invention.
Figure 23:
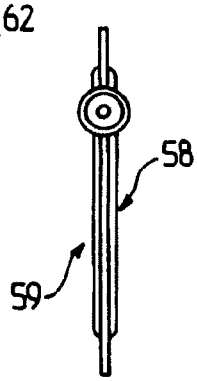

In an alternate example, as shown in FIGS. 22 and 23, it is possible to form the cooling channel simultaneously in the two principal surfaces facing the first and second parts 58 and 59, either by stamping or by machining.

It will also be noted that the two parts 58 and 59 forming the diffuser 18 are typically made of metal, for example brass or aluminium, so as to impart good heat conducting properties thereto. However, the first part 58 and second part 59 can also be made of a thermoplastic resin, or one can be made in a thermoplastic resin and the other in metal. In addition, the diffuser 18 can be over-molded directly with the first container 15.

Referring again to FIG. 1, in addition to the recesses 5 and 7, the casing 4 can include a third recess 67 designed to receive one or more power supply batteries for the motor 27.

Preferably, the recess 67 is formed under a removable cover 68 facilitating, on the one hand, replacement of the battery or batteries, or replacement or filling of the first and second containers 6 and 6'.

The casing 4 is typically provided with a switch 69 to start and stop the motor. Preferably, provision will also be made to equip the valve 14 of the second container 6' with an additional electrical actuator controlled by the switch 69 so as to simultaneously cause the drum 20 to rotate and to distribute refrigerant product through the diffuser 18.

As shown in FIG. 1, in the zone Z of the body 4 extending at least partially around the first container, there can be provided a resiliently deformable wall designed to facilitate, by exerting pressure thereon, distribution of the product to be dispensed through the diffuser 18. The zone Z at least partially envelopes the first container and is sufficiently flexible so as to allow a user to control the amount of product dispensed via the user's manual grip of the zone Z.

By virtue of the arrangement just described, it is possible to dispense a cooled cosmetic product via a compact arrangement provided with a "roller" or "ball" type applicator, for example.

In order to apply a measured quantity of product, a user can operate the switch 69 and manually press on the body 4. Product is then delivered from the first container 6 to the diffuser 18 through the first part 58 so as to be diffused along the active surface of the diffuser 18.

Simultaneously, the product is cooled under the effect of the expansion of the refrigerant product in the diffuser 18. The cooled product then passes through the apertures formed in the cradle so as to be taken up by the rotating drum 20.

When the drum 20 is applied against the skin, the cooled product can be dispensed. In addition, during application, the drum 20 typically deforms to assume a bossed shape which, upon application, exerts a massaging action on the skin.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device to cool and apply a product, the device comprising:

a pressurized container configured to hold a liquefied refrigerant product, the pressurized container including a longitudinal axis and provided with a refrigerant product dispensing element;

cooling means including at least one refrigerant product vaporization conduit connected in fluid communication with the refrigerant product dispensing element; and an applicator coating element including an applicator coating surface configured to face an applicator mounted on the device, the applicator coating surface disposed adjacent to the vaporization conduit so as to exchange heat with the vaporization conduit while the refrigerant product is dispensed from the dispensing element into the vaporization conduit.

2. The device according to claim 1, wherein the vaporization conduit extends transversely relative to the longitudinal axis of the pressurized container.

3. A device to cool and apply a product comprising:

a pressurized container configured to hold a liquefied refrigerant product, the pressurized container including a longitudinal axis and provided with a refrigerant product dispensing element;

cooling means including at least one refrigerant product vaporization conduit connected in fluid communication with the refrigerant product dispensing element; and an applicator coating element including an applicator coating surface, the applicator coating surface disposed adjacent to the vaporization conduit so as to exchange heat with the vaporization conduit while the refrigerant product is dispensed from the dispensing element into the vaporization conduit, wherein the applicator coating surface includes a concave surface, and the applicator coating element is mounted on the refrigerant product dispensing element transversely relative to the longitudinal axis.

4. The device according to claim 1, wherein the applicator coating element includes two plates, and at least one of the two plates comprises a portion of the vaporization conduit.

5. The device according to claim 4, wherein the vaporization conduit is a stamped formation in at least one of the two plates.

6. The device according to claim 4, wherein the vaporization conduit is a machined portion of at least one of the two plates.

7. The device according to claim 4, wherein the vaporization conduit includes a multi-turn pathway.

8. The device according to claim 7, wherein the refrigerant product vaporization conduit is connected in fluid communication with the refrigerant product dispensing element via a fitting configured to be coupled to a hose.

9. A packaging and dispensing assembly for a product comprising:

a product storage container including an applicator and an applicator coating element with an applicator coating surface configured to coat the applicator with product fed from the product storage container; and a product cooling device including a pressurized container holding a liquefied refrigerant product, the pressurized container including a longitudinal axis and a refrigerant product dispensing element, and cooling means including at least one refrigerant product vaporization conduit connected in fluid communication to the refrigerant product dispensing element and disposed proximate to the applicator coating surface so as to exchange heat with the applicator coating surface.

10. The assembly according to claim 9, wherein the applicator is a drum mounted so as to be rotatable relative to the applicator coating surface, and the applicator coating surface has a shape complimentary to a surface of the drum.

11. The assembly according to claim 10, wherein the drum has a convex shape and the applicator coating surface has a concave shape.

12. The assembly according to claim 11, wherein the drum comprises a manually deformable material and includes at least one external boss.

13. The assembly according to claim 10, wherein the drum includes a rotary cylindrical support and a manually deformable application surface mounted around a rotary cylinder.

14. The assembly according to claim 13, wherein the cylindrical support is provided with an arrangement of at least one boss configured to produce a localized deformation of the application surface during application of the product.

15. The assembly according to claim 13, wherein the application surface includes a median zone having a diameter greater than that of the cylindrical support such that when the cylindrical support rotates, the application surface is applied against a user's skin, on one side, against the cylindrical support and, on the opposite side, is applied against the applicator coating surface.

16. The assembly according to claim 10, further comprising a drive motor coupled to the drum.

17. The assembly according to claim 16, further comprising a drum driving cylinder driven in rotation by the motor via a gear mechanism.

18. The assembly according to claim 17, wherein the driving cylinder is driven in rotation by the motor via a gear-motor system.

19. The assembly according to claim 18, wherein the driving cylinder is driven in rotation by the motor via an overdrive system.

20. The assembly according to claim 16, further comprising a switch controlling the operation of the motor, the switch being configured to simultaneously control the operation of the refrigerant product dispensing element so as to cause the cooling device to cool the applicator as the applicator rotates.

21. The assembly according to claim 9, wherein the product storage container comprises a manually deformable material.

22. The assembly according to claim 21, further comprising a casing provided with a manually deformable zone at least partially enveloping the product storage container.

23. The assembly according to claim 22, wherein the casing includes a recess to receive power supply means for the assembly.

24. The assembly according to claim 9, wherein the vaporization conduit includes a multi-turn pathway.

25. The assembly according to claim 9, wherein the refrigerant product vaporization conduit is connected in fluid communication with the refrigerant product dispensing element via a fitting configured to be coupled to a hose.

26. The device according to claim 1, further comprising the applicator directly facing the applicator coating surface.

27. The device according to claim 1, wherein the vaporization conduit extends within the applicator coating element in a direction parallel to the applicator coating surface.

28. The device according to claim 9, wherein the vaporization conduit extends within the applicator coating element in a direction parallel to the applicator coating surface.

* * * * *